US006467809B2

(12) United States Patent
Scheinblum

(10) Patent No.: US 6,467,809 B2
(45) Date of Patent: Oct. 22, 2002

(54) GREETING CARD HAVING A CONCEPTIONDAY WHEEL

(76) Inventor: Keith Scheinblum, 34 Old Pond Rd., Great Neck, NY (US) 11023

( * ) Notice: Subject to any disclaimer, the term of this patent is extended or adjusted under 35 U.S.C. 154(b) by 14 days.

(21) Appl. No.: 09/766,040

(22) Filed: Jan. 19, 2001

(65) Prior Publication Data

US 2002/0096873 A1 Jul. 25, 2002

(51) Int. Cl.[7] ..... B42D 15/00
(52) U.S. Cl. ..... 283/65; 283/117; 235/85 FC
(58) Field of Search ..... 283/65, 117; 40/124, 40/124.12; 235/85 FC, 88 R

(56) References Cited

U.S. PATENT DOCUMENTS 1,428,065 A * 9/1922 Tidswell ..... 235/85 FC
2,520,208 A * 8/1950 Green ..... 235/85 FC
2,650,764 A * 9/1953 Pirszel ..... 235/85 FC
5,318,327 A * 6/1994 Daneshvar ..... 283/117

* cited by examiner

*Primary Examiner*—William Fridie, Jr.
(74) *Attorney, Agent, or Firm*—Ezra Sutton

(57) ABSTRACT

A greeting card having a calculation wheel for determining the conception date of the user. The conceptionday greeting card includes a card member having at least one wall; and a conceptionday calculation wheel rotatably mounted on the at least one wall. The conceptionday calculation wheel includes an outer peripheral wheel section having first indicia thereon in the form of months and calendar days; and the calculation wheel also includes an inner wheel section rotatable relative to the outer peripheral wheel section; the inner wheel section having second indicia thereon in the form of a birth date marker and a conception date marker. Rotation of the birth date marker of the inner wheel section relative to the outer peripheral section is used to indicate the birth date of the user for determining the conception date of the user from the conception date marker of the inner section of the calculation wheel.

44 Claims, 7 Drawing Sheets

GREETING CARD HAVING A CONCEPTIONDAY WHEEL

FIELD OF THE INVENTION

This invention relates to a greeting card having a conceptionday calculation wheel or sliding member thereon. More particularly, the happy conceptionday greeting card and conceptionday calculation wheel or sliding member is used to determine and celebrate the person's conceptionday, by just setting that person's birthday on the conceptionday calculation wheel or sliding member in order to determine that individual's conceptionday.

BACKGROUND OF THE INVENTION

The use of greeting cards for celebrating an individual's birthday is well-known in the art. Further, the use of greeting cards having openings on one of its card walls for displaying calendars, indicia, photographs, artwork and the like is also well-known in the art.

There remains a need for a greeting card for determining and celebrating an individual's conceptionday by just using the individual's birthday on a conceptionday calculation wheel or sliding member in order to determine that individual's conceptionday.

DESCRIPTION OF THE PRIOR ART

Greeting cards, display cards, display exhibits having movable disks, screens, grids and the like with various designs, structures, configurations and materials of construction have been disclosed in the prior art. For example, U.S. Pat. No. 4,024,656 to Farnworth discloses a greeting card calendar having a single folded sheet of card stock forming a front panel over a back panel. The fold is on the vertical side of the card and the front panel is made to be manually removable from the back panel as by the fold being perforated. The front panel has an aperture. A calendar pad is mounted on the back panel so that it can be viewed through the aperture. The back panel is scored and/or die cut to permit it being folded into a triangular easel that mounts and displays the calendar pad. This prior art patent does not teach or disclose the structure, design and configuration of the present invention of a greeting card having a conceptionday calculation wheel or sliding member thereon.

U.S. Pat. No. 5,822,896 to Milstein discloses a dioramic greeting card having a viewing window through which a picture or photo display or other decorative indicia disposed on a concave panel behind the window is viewed. The dioramic greeting card has a construction that includes three panels or segments. One panel has a viewing window, the second panel typically has a written message imprinted thereon, and the third panel includes an attractive picture or photo display. The card's construction is made from a cardboard blank which is appropriately folded and manipulated in order to construct the greeting card. The blank includes a series of panels foldably connected to each other along common fold lines. This prior art patent does not teach or disclose the structure, design and configuration of the present invention of a greeting card having a conceptionday calculation wheel or sliding member thereon.

U.S. Pat. No. 6,009,647 to Feingold discloses a mechanical display device for use as a sign or advertisement in which to attract attention. The display device includes various basic and auxiliary segments which move in relation to one another causing attracting to images of various messages, shapes, designs and colors. The plurality of rotating segments each carrying elements of a message or sign, each rotating relative to each other, the center of rotation of each being concentric to each other. These segments are driven by a series of planetary gear systems or their equivalent, arranged in layers, each driving the next. To these segments may be attached a plurality of auxiliary devices, all driven by the same mechanism, which can enhance the attraction of the device, carry elements of the message, etc. Each segment or auxiliary device can be of a variety of shapes, colors, graphics, etc. Segments can be nested or overlapping, totally or in combination in any relation to each other. Message can be continuously or intermittently scrambled and unscrambled. This prior art patent does not teach or disclose the structure, design and configuration of the present invention of a greeting card having a conceptionday calculation wheel or sliding member thereon.

None of the prior art patents teach or disclose the structure, design and configuration of the present invention of a conceptionday greeting card having a conceptionday calculation wheel or sliding member thereon for determining an individual's conceptionday byjust using the individual's birthday in order to determine that individual's conceptionday for celebration.

Accordingly, it is an object of the present invention to provide a happy conceptionday greeting card having a conceptionday calculation wheel or sliding member on one of the cards' walls for determining an individual's conceptionday in one step.

Another object of the present invention is to provide a happy conceptionday greeting card such that the conceptionday calculation wheel includes an outer peripheral wheel section having first indicia thereon in the form of months and calendar days; and having an inner wheel section being rotatable relative to the outer peripheral wheel section and having second indicia thereon in the form of a birth date marker and a conception date marker for determining the conceptionday of an individual by simply using that individual's birth date.

Another object of the present invention is to provide a happy conceptionday greeting card wherein the conceptionday calculation wheel includes a 266 day difference between the birth date marker and the conception date marker which represents the approximate 38 week gestation period of pregnancy prior to birth of that individual.

Another object of the present invention is to provide a happy conceptionday greeting card wherein the conceptionday calculation wheel or sliding member is separable and/or detachable from the greeting card.

Another object of the present invention is to provide a happy conceptionday greeting card wherein the conceptionday calculation wheel or sliding member is in a cooperative relationship with the greeting card.

A further object of the present invention is to provide a happy conceptionday greeting card having a conceptionday calculation wheel or sliding member being attached thereto that can be mass produced in an automated and economical manner and is readily affordable by the consumer.

SUMMARY OF THE INVENTION

In accordance with the present invention, there is provided a greeting card having a calculation wheel for determining the conception date of the user. The conceptionday greeting card includes a card member having at least one wall; and a conceptionday calculation wheel rotatably mounted on the at least one wall. The conceptionday calculation wheel includes an outer peripheral wheel section having first indicia thereon in the form of months and calendar days; and the calculation wheel also includes an inner wheel section rotatable relative to the outer peripheral wheel section; the inner wheel section having second indicia thereon in the form of a birth date marker and a conception date marker, Rotation of the birth date marker of the inner wheel section relative to the outer peripheral section is used to indicate the birth date of the user for determining the conception date of the user from the conception date marker of the inner section of the calculation wheel.

In an alternate embodiment of the present invention, there is provided a greeting card having a calculation sliding member for determining the conception date of the user. The conceptionday greeting card includes a card member having at least one wall; and a conceptionday calculation sliding member slidably mounted relative to the at least one wall. The conceptionday calculation sliding member includes a front wall having first indicia thereon in the form of months and days. The at least one wall has a passageway therein for slidably receiving the conceptionday calculation sliding member therethrough. The at least one wall member having first and second windows formed therein; and for slidably moving of the conceptionday calculation sliding member through the passageway relative to the at least one wall member to position the conceptionday calculation sliding member to line-up with the user's birth date with the first window to determine the conception date of the user in the second window.

BRIEF DESCRIPTION OF THE DRAWINGS

Further objects, features, and advantages of the present invention will become apparent upon the consideration of the following detailed description of the presently preferred embodiment when taken in conjunction with the accompanying drawings, wherein.

DETAILED DESCRIPTION OF THE PREFERRED EMBODIMENT 10

Figure 1:
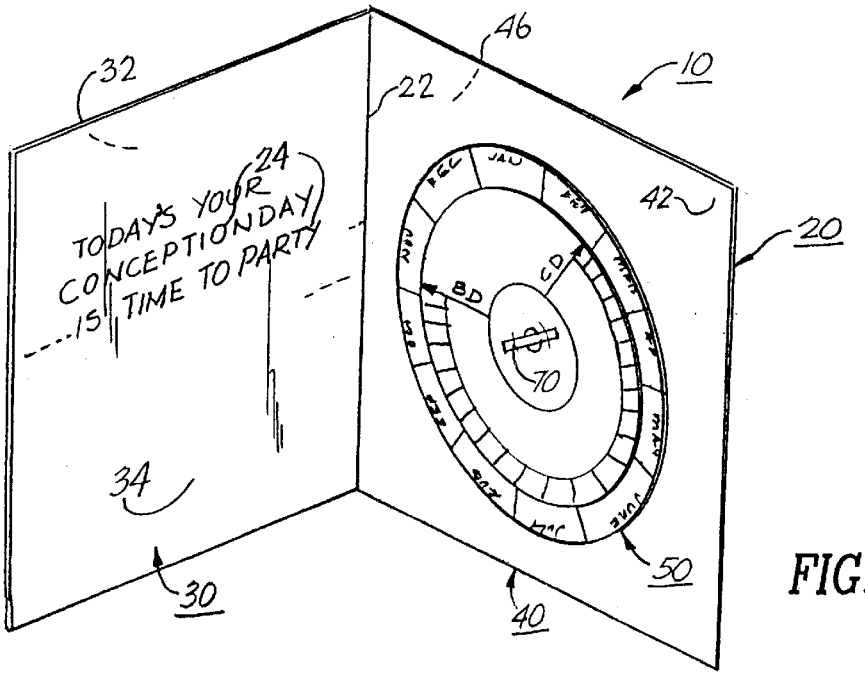
FIG. 1 is a front perspective view of the conceptionday greeting card of the preferred embodiment of the present invention showing the conceptionday calculation wheel attached to the rear panel of card.
Figure 2:
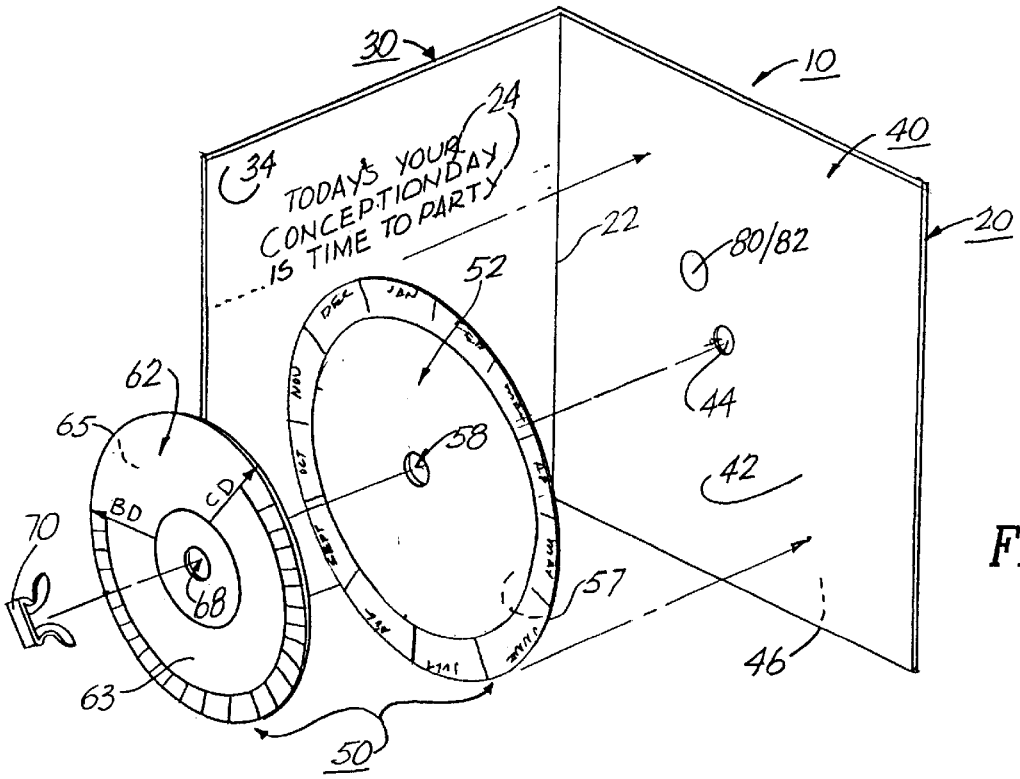
FIG. 2 is an exploded front perspective view of the conceptionday greeting card of the preferred embodiment of the present invention showing the conceptionday calculation wheel being attached to an opening on the rear panel by a clipping/pin member.
Figure 3:
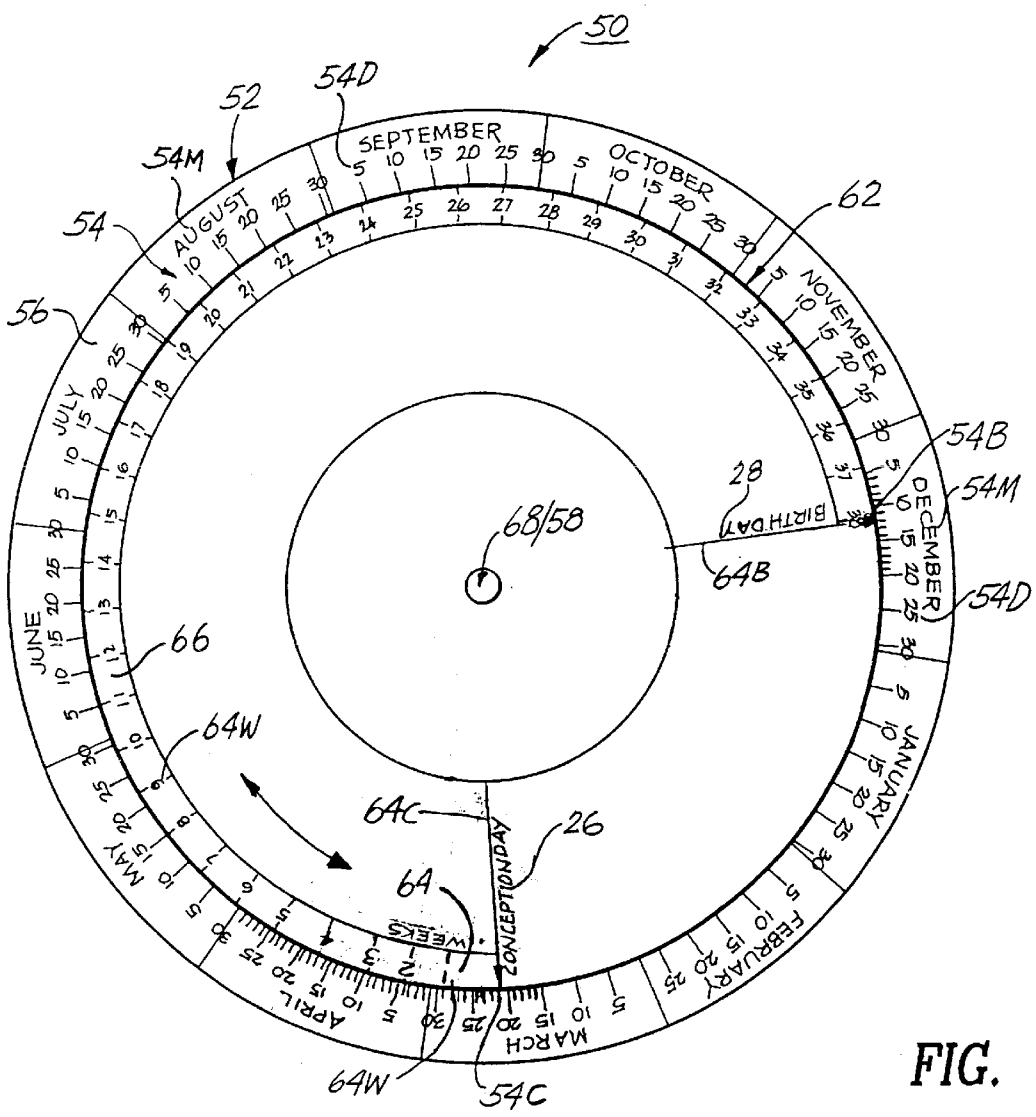
FIG. 3 is a top plan view of the conceptionday greeting card of the preferred embodiment of the present invention showing the conceptionday calculation wheel having an outer peripheral wheel section with first indicia thereon in the form of months and calendar days; and having an inner wheel section being rotatable relative to the outer peripheral wheel section; and the inner wheel section having second indicia thereon in the form of weeks, a birth date marker and a conception date marker for determining the conceptionday of an individual by just using that individual's birth date.
Figure 1A:
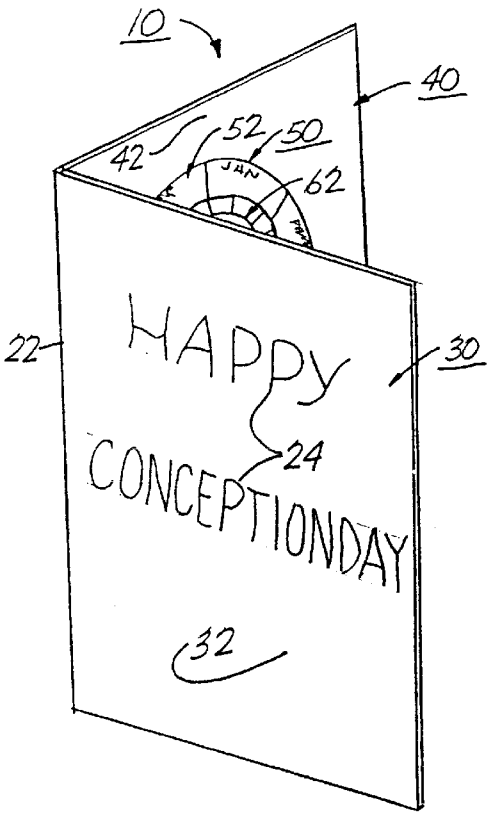
FIG. 1A is a front perspective view of the conceptionday greeting card of the preferred embodiment of the present invention showing the front panel having indicia thereon and the rear panel having the conceptionday calculation wheel thereon.

The conceptionday greeting card 10 and its component parts of the preferred embodiment of the present invention are represented in detail by FIGS. 1 through 3 of the patent drawings. The conceptionday greeting card 10 comprises a sheet of plastic or card stock 20 that may be white or colored, mat, smooth or glossy as desired, folded once along a vertical edge or fold line 22 [when card 10 is oriented for reading the indicia 24 (message) thereon] to form a front panel 30 and a rear panel 40. Fold line 22 can be perforated in order to separate the front panel 30 from the rear panel 40 of greeting card 10, if desired by the user, such that the conceptionday calculation wheel 50 can be used on other occasions for determining the conceptionday 26 of a user. Front panel 30 includes a front wall surface 32 and a first inner wall surface 34. Each of the wall surfaces 32 and 34 of front panel 30 may include indicia 24 in the form of a message or greeting with reference to an individual's conceptionday. Rear panel 40 includes a second inner wall surface 42 having a centrally located hole opening 44 and a back wall surface 46. Each of the wall surfaces 42 and 46 of rear panel 40 may include indicia 24 in the form of a message or greeting with reference to an individual's conceptionday. Opening 44 of inner wall surface 42 is used for mounting of a conceptionday calculation wheel 50 thereon via a clipping pin member 70 therethrough, as depicted in FIG. 2 of the drawings.

The conceptionday calculation wheel 50, as shown in FIG. 3 of the drawings, includes an outer peripheral wheel section 52 having first indicia 54 thereon in the form of months 54M and calendar days 54D (located along the outer perimeter wall surface 56 of wheel section 52), a back wall surface 57 and a center hole opening 58. The conceptionday calculation wheel 50 further includes an inner wheel section 62 having a front wall surface 63 and a back wall surface 65 being rotatable relative to the outer peripheral wheel section 52. The inner wheel section 62 includes second indicia 64 thereon in the form weeks 64W (located along the outer perimeter wall surface 66 of inner wheel section 62), a birth date marker (↑) 64B, and a conception date marker (↑) 64C for determining the conceptionday 26 of an individual by just using that individual's birthday 28. The inner wheel section 62 also includes a center hole opening 68 that is aligned with center hole opening 58 of the outer peripheral wheel section 52 via clipping pin member 70 in order to enable the inner wheel section 62 to rotate relative to the outer peripheral wheel section 52. Attentive connecting means include a spindle member, a bolting member, a clipping member or a pin. The front wall surface 63 of the inner wall section 62 and the back wall surface 57 of the outer peripheral wheel section 52, respectively, may also include indicia 24 in the form of a message or greeting with reference to an individual's conceptionday.

Additionally, the conceptionday calculation wheel 50 includes a general range of 250 to 280 days difference (with a preferred range of 266 to 269 days difference) between the birth date marker (↑) 64B and the conception date marker (↑) 64C which represents the approximate 38 week gestation period of pregnancy prior to the birth of that individual.

The back wall surface 57 of the outer peripheral wheel section 52 is held in a fixed position on the second inner wall surface 42 of rear panel 40 by the use of double-sided adhesive tape 80 or detachable glue 82, as depicted in FIG. 2, if needed.

The conceptionday calculation wheel 50 can be made from materials such as light-weight metals, plastic or card stock materials having a white or colored, mat, smooth or glossy finishes for the imprinting of all appropriate indicia thereon.

FIRST ALTERNATE EMBODIMENT 100

Figure 4:
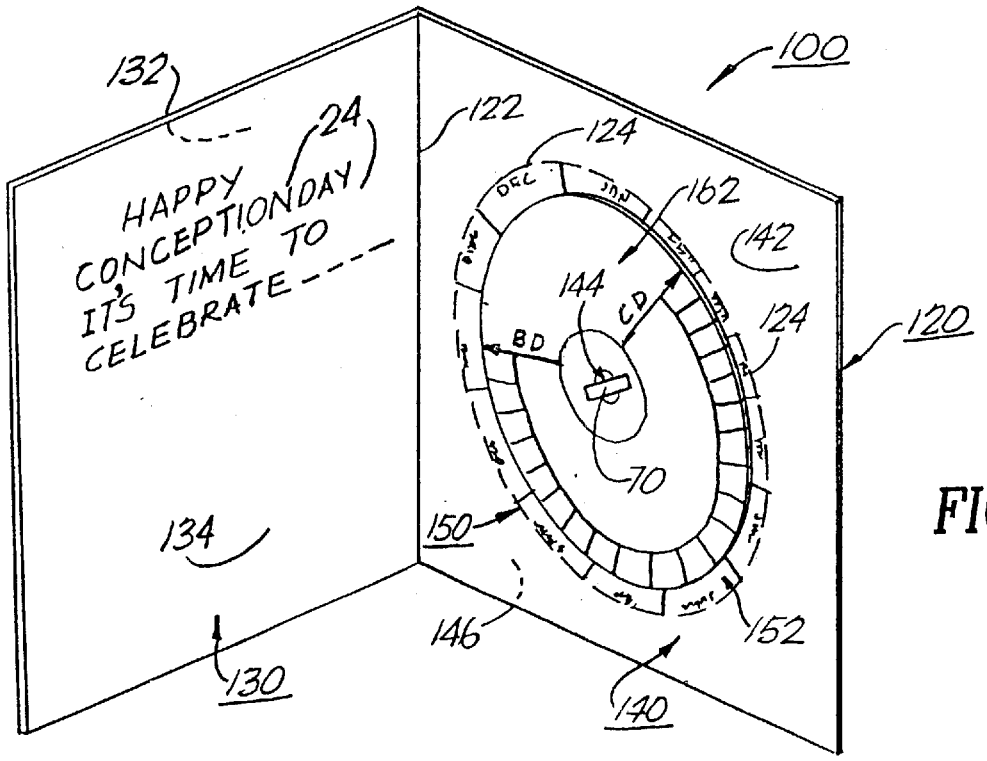
FIG. 4 is a front perspective view of the conceptionday greeting card of the first alternate embodiment of the present invention showing the conceptionday calculation wheel having an outer perforated edging in which to detachably separate from the rear panel of the card.
Figure 5:
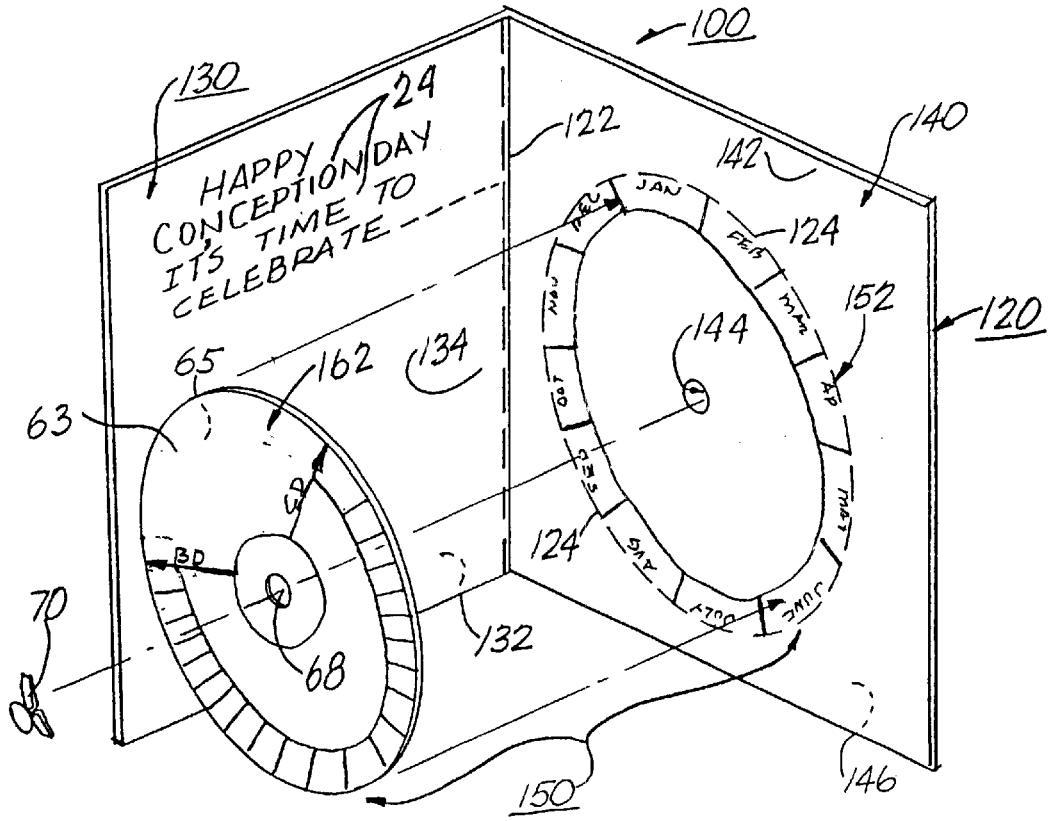
FIG. 5 is an exploded front perspective view of the conceptionday greeting card of the first alternate embodiment of the present invention showing the inner wheel section being attached to an opening on the outer peripheral wheel section formed on the rear panel of the card by a clipping/pin member in which to form an assembled conceptionday calculation wheel thereto.

The conceptionday greeting card 100 and its component parts of the first alternate embodiment of the present invention and its component parts are represented in detail by FIGS. 4 and 5 of the patent drawings. The conceptionday greeting card 100 comprises a sheet of card stock 120 that may be white or colored, mat, smooth or glossy as desired, folded once along a vertical edge or fold line 122 [when card 100 is oriented for reading the indicia 24 (message) thereon] to form a front panel 130 and a rear panel 140. Front panel 130 includes a front wall surface 132 and a first inner wall surface 134. Each of the wall surfaces 132 and 134 of front panel 130 may include indicia 24 in the form of a message or greeting with reference to an individual's conceptionday. Rear panel 140 includes a second inner wall surface 142 having a centrally located hole opening 144 and a back wall surface 146. Also, each of the wall surfaces 142 and 146 of rear panel 140 may include indicia 24 in the form of a message or greeting with reference to an individual's conceptionday.

The second inner wall surface 142 (as part of its rear panel 140) includes the rear portion 152 (the outer peripheral wheel section) of the conceptionday calculation wheel 150, and is used for mounting the inner wheel section 162 to the outer peripheral wheel section 152 via hole opening 144 and clipping pin member 70. The outer peripheral wheel section 152 can be detachably removed along a perforated edging 124, as depicted in FIG. 5 of the drawings. All other aspects of the conceptionday calculation wheel 150 of the alternate embodiment 100 are exactly the same as the conceptionday calculation wheel 50 of the preferred embodiment 10.

In an alternate format of embodiment 100, vertical fold line 122 can be perforated, instead of the perforated edging 124 of the outer peripheral wheel section 152, as depicted in FIG. 5 of the drawings, wherein the rear panel 140 then can be detachably separated from the front panel 130. In this manner, the conceptionday calculation wheel 150—is part of the separated rear panel 140 and can be used on other occasions for determining the conceptionday of a user.

SECOND ALTERNATE EMBODIMENT 200

The conceptionday greeting card 200 and its component parts of the second alternate embodiment of the present invention are represented in detail by FIGS. 6, 6A, 6B and 8 of the patent drawings. The conceptionday greeting card 200 comprises a sheet of plastic or card stock 220 that may be white or colored, mat, smooth or glossy as desired, folded once along a vertical edge or fold line 222 [when card 200 is oriented for reading the indicia 24 (message) thereon] to form a front panel 230 and a rear panel 250. Fold line 222 can be perforated in order to separate the front panel 230 from the rear panel 250 of greeting card 200, if desired by the user.

Front panel 230 includes a front wall 232 having a front wall surface 234 and an inner wall 236 having a first inner wall surface 238. Front wall 232 and inner wall 236 are used to form a passageway sleeve 240 for receiving a conceptionday calculation sliding member 260 therethrough. Front wall 232 includes a first viewing opening 242 and a second viewing opening 244. Rear panel 250 includes a second inner wall surface 252 and a back wall surface 254. Each of the wall surfaces 234,238 and 252 of the front and rear panels 230 and 250, respectively, may include indicia 24 in the form of a message or greeting with reference to an individuals' conceptionday. Front wall surface 234 further includes a birthday marker (→) 224 adjacent to the first viewing opening 242 and a conceptionday marker (→) 226 adjacent to the second viewing opening 244. The distance D between the first viewing opening 242 and the birthday marker (→) 224 with that of the second viewing opening 244 and the conceptionday marker (→) 226 represents a general range of 250 to 280 days difference (with a preferred range 266 to 269 days difference) in which to show the approximate 38 week gestation period of pregnancy prior to the birth of that individual.

Figures 6, 6A, 6B:
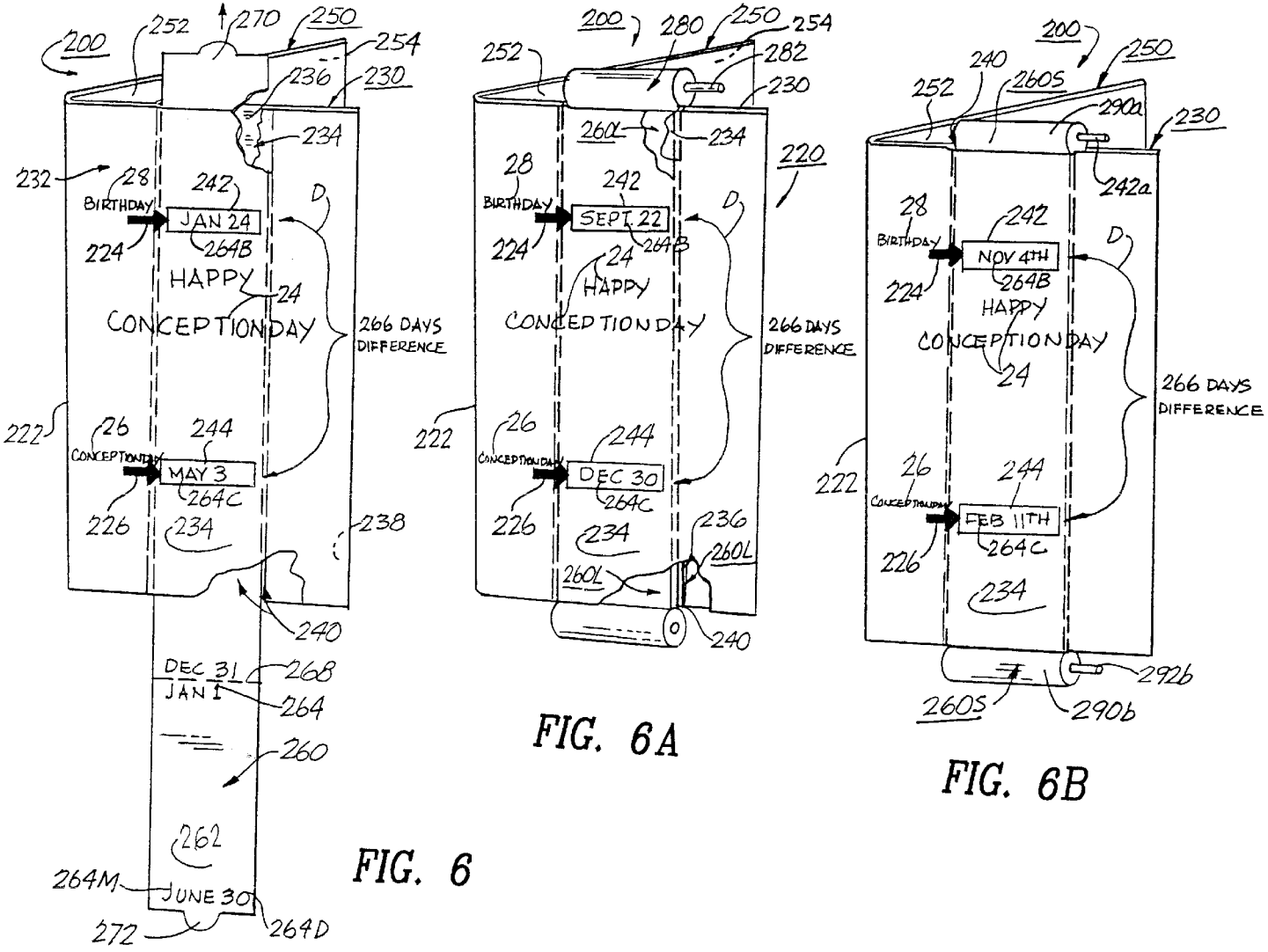
FIG. 6 is a front perspective view of the conceptionday greeting card of the second alternate embodiment of the present invention showing the front panel of the card having a conceptionday sliding member therein, a birthday viewing opening and a conceptionday viewing opening; and having a sliding member passageway therein for receiving the conceptionday sliding member therethrough.
FIG. 6A is a front perspective view of the conceptionday greeting card of the second alternate embodiment of the present invention showing the front panel having the calculation sliding member within the sliding member passageway in the form of a continuous looping member.
FIG. 6B is a front perspective view of the conceptionday greeting card of the second alternate embodiment of the present invention showing the front panel having the calculation sliding member within the sliding member passageway in the form of a scrolling slide member.
Figure 8:
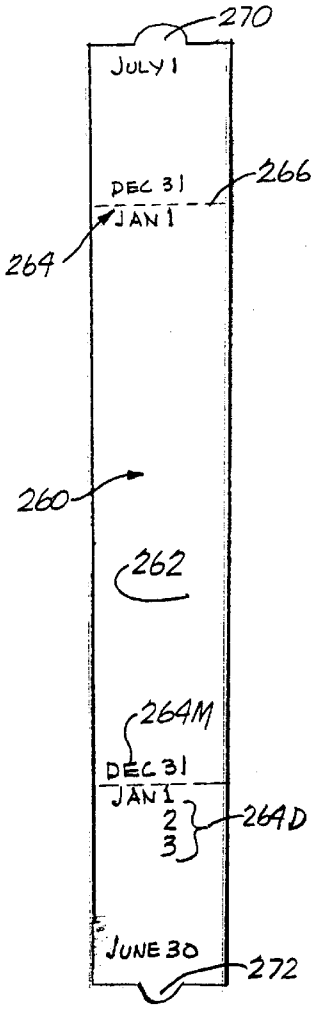
FIG. 8 is a top plan view of the conceptionday greeting card of the second alternate embodiment of the present invention showing the conceptionday sliding member having indicia in the form of months and calendar days thereon.

The conceptionday calculation sliding member 260 has an elongated rectangular-shaped configuration, as shown in FIG. 8 of the drawings, and includes a front wall surface 262 having indicia 264 thereon in the form of months 264M and days 264D. Conceptionday calculation sliding member 260 also includes upper and lower fold lines 266 and 268, respectively, for folding the sliding member 260 when the conceptionday greeting card 200 is not in use. Conceptionday calculation sliding member 260 further includes upper and lower tab members 270 and 272, respectively, for pulling the sliding member 260 through the passageway sleeve 240, as depicted in FIG. 6 of the drawings. The conceptionday calculation sliding member 260 can also be formed in a continuous loop member 260L or be formed in a scrolling member 260S, as depicted in FIGS. 6A and 6B, respectively. The conceptionday calculation sliding continuous loop member 260L includes a looping device member 280 with a turning knob 282 for turning the continuous loop member 260L within the passageway sleeve 240. The conceptionday calculation sliding scrolling member 260S includes upper and lower scrolling elements 290*a* and 290*b* each having a scrolling knob 292*a* and 292*b* for moving the sliding scrolling member 260S upward or downward within the passageway sleeve 240. In all other aspects, the continuous loop member 260L and the sliding scrolling member 260S function exactly the same as the conceptionday calculation sliding member 260 of embodiment 200.

When conceptionday greeting card 200 is in use, the calculation sliding member 260, 260L and 260S is slidably moved within the passageway sleeve 240 relative to the inner wall 236 of front panel 230, such that the conceptionday calculation sliding member 260, 260L and 260S is used to line-up with the birthday marker (→) 224 of the user's birthday 28 within the first viewing opening/window 242 in order to determine the conception date 26 of the user by lining up with the conception date marker (→) 226 within the second viewing opening/window 244, as depicted in FIGS. 6, 6A and 6B of the drawings.

THIRD ALTERNATE EMBODIMENT 300

Figure 7:
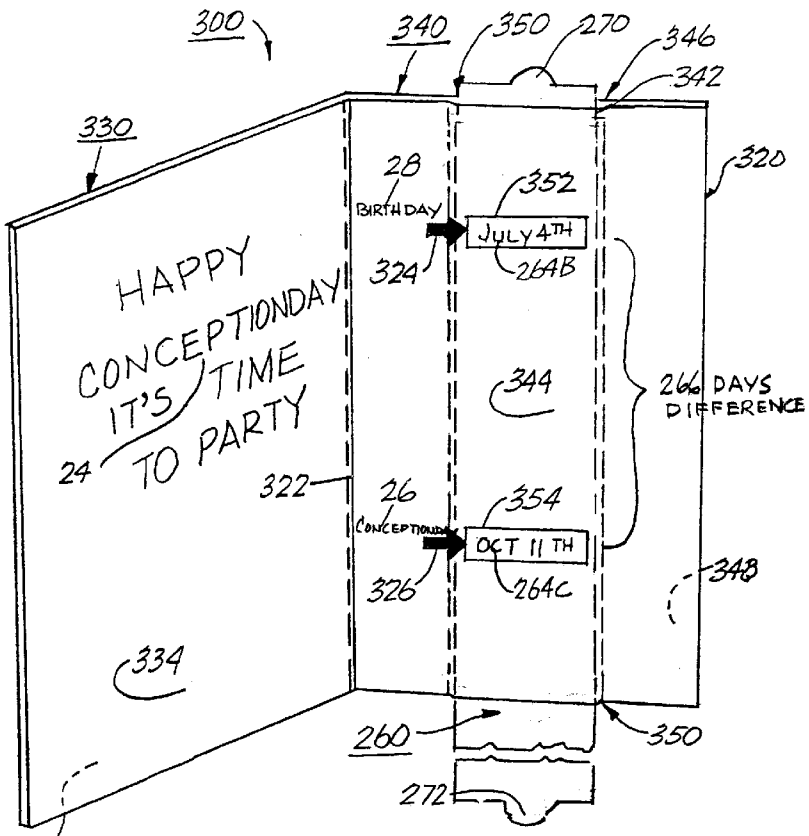
FIG. 7 is a front perspective view of the conceptionday greeting card of the third alternate embodiment of the present invention showing the rear panel of the card having a sliding member passageway therein for receiving the conceptionday sliding member therethrough.

The conceptionday greeting card 300 and its component parts of the third alternate embodiment of the present invention are represented in detail by FIGS. 7 and 8 of the patent drawings. The conceptionday greeting card 300 comprises a sheet of plastic or card stock 320 that may be white or colored, mat, smooth or glossy as desired, folded once along a vertical edge or fold line 322 [when card 300 is oriented for reading the indicia 24 (message) thereon] to form a front panel 330 and a rear panel 340. Fold line 322 can be perforated in order to separate the front panel 330 from the rear panel 340 of greeting card 300, if desired by the user.

Front panel 330 includes a front wall surface 332 and a first inner wall surface 334. Rear panel 340 includes an inner front wall 342 having an inner front wall surface 344 and a rear wall 346 having a back wall surface 348. Inner front wall 342 and rear wall 346 are used for form a passageway sleeve 350 for receiving the conceptionday calculation sliding member 260 therethrough. Inner front wall 342 includes a first viewing opening or window 352 and a second viewing opening or window 354. Each of the wall surfaces 332, 334, 344 and 348 of the front and rear panels 330 and 340, respectively, may include card indicia 24 in the form of a message or greeting with reference to an individuals's conceptionday. Inner front wall surface 344 further includes a birthday marker (→) 324 adjacent to the first viewing opening 352 and a conceptionday marker (→) 326 adjacent to the second viewing opening 354. The distance D between the first viewing opening 352 and the birthday marker (→)324 with that of the second viewing opening 354 and the conceptionday marker (→) 326 represents a general range of 250 to 280 days difference (with a preferred range 266 to 269 days difference) in which to show the approximate 38 week gestation period of pregnancy prior to the birth of that individual.

The conceptionday calculation sliding member 260 has an elongated rectangular-shaped configuration, as shown in FIG. 8 of the drawings, and includes a front wall surface 262 having indicia 264 thereon in the form of months 264M and days 264D. Conceptionday calculation sliding member 260 also includes upper and lower fold lines 266 and 268, respectively, for folding the sliding member 260 when the conceptionday greeting card 300 is not in use. Conceptionday calculation sliding member 260 further includes upper and lower tab members 270 and 272, respectively, for pulling the sliding member 260 through the passageway sleeve 350, as depicted in FIG. 6 of the drawings.

When conceptionday greeting card 300 is in use, the calculation sliding member 260, 260L and 260S is slidably moved within the passageway sleeve 350 relative to the rear wall 346 of rear panel 340, such that the conceptionday calculation sliding member 260 is used to line-up with the birthday marker (→) 324 of the user's birthday 28 within the first viewing opening/window 352 in order to determine the conception date 26 of the user by lining up with the conception date marker (→) 326 within the second viewing opening/window 354, as depicted in FIG. 7 of the drawings.

Figure 7A:
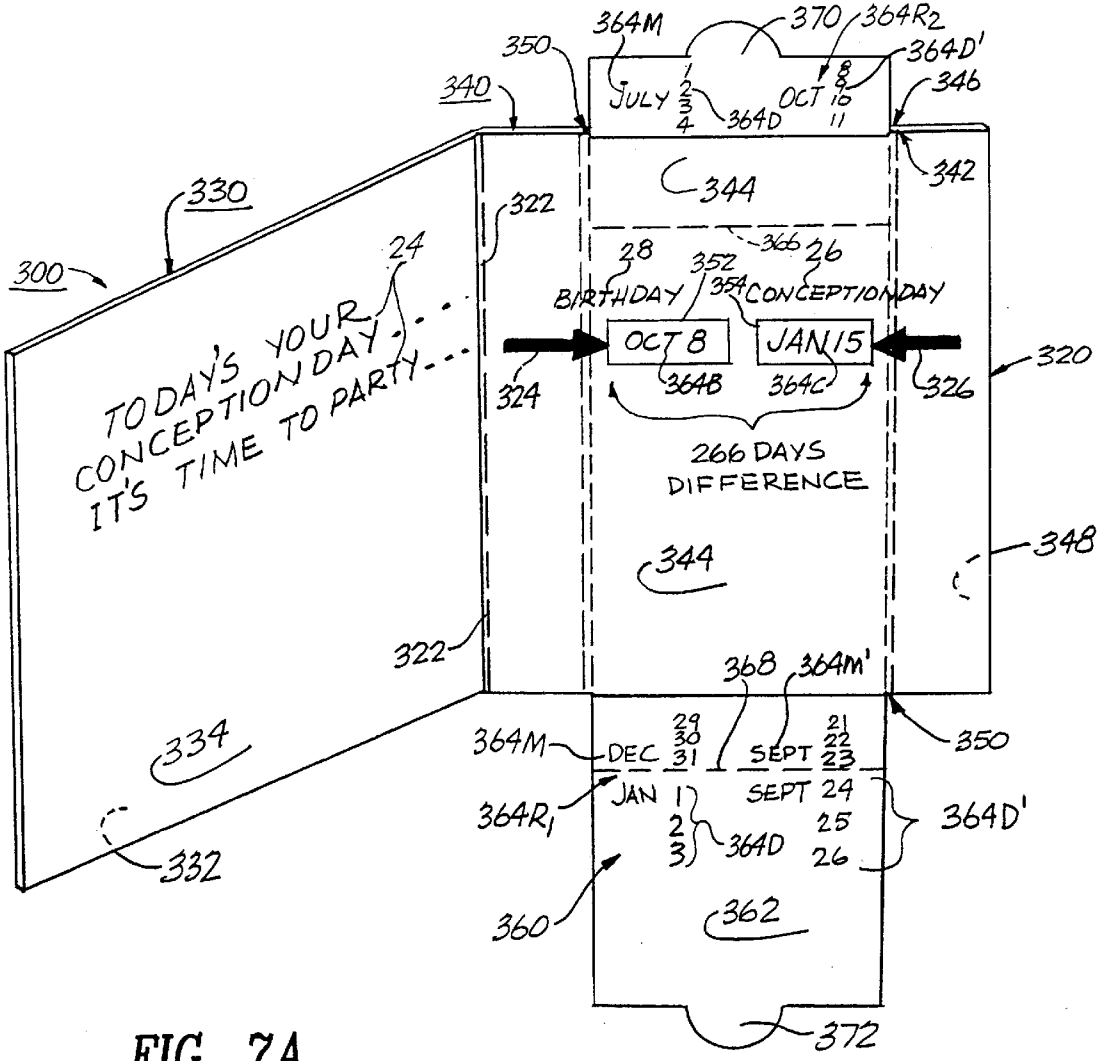
FIG. 7A is a front perspective view of the conceptionday greeting card of the third alternate embodiment of the present invention showing the rear panel of the card having a sliding member passageway therein for receiving a modified conceptionday sliding member therethrough.

In an alternate format of embodiment 300, as shown in FIG. 7A, calculation sliding member 260 is replaced with calculation sliding member 360, and the first and second viewing windows 352 and 354, respectively, are aligned and adjacent to each other on the inner front wall 342. Inner front wall surface 344 further includes a birthday marker (→) 324 adjacent to the first viewing opening 352 and a conceptionday marker (←) 326 adjacent to the second viewing window 354, wherein each of the markers 324 and 326 are aligned on the same longitudinal axis with each other, as depicted in FIG. 7A of the drawings. The calculation sliding member 360 includes a front wall surface 362 having a first row 364$R_1$ of indicia markings in the form of months 364M and calendar days 364D representing the user's birthday 28 and having a second row 364$R_2$ of indicia markings in the form of months 364M' and calendar days 364D' representing the user's conceptionday date 26. The month 364M and calendar day 364D of the first row of indicia markings 364$R_1$ has a 266 day difference from the month 364M' and calendar day 364D' of the second row of indicia markings 364$R_2$. For example, as shown in FIG. 7A, when the user aligns the birthday marker (→) 324 with his or her birthday 28, such as OCTOBER $8^{th}$ as shown by 364B of the indicia markings, within the first viewing window 352, the conceptionday marker (←) 326 then indicates the conceptionday date 26 within the second viewing window 354 being JANUARY $15^{th}$ ,as shown by 364C of the indicia markings. In all other aspects this alternate format, is the same as embodiment 300 previously described. Additionally, calculation sliding member 360 include supper and lower pull tabs 370 and 372, respectively, for pulling the sliding member 360 through passageway sleeve 350.

FOURTH ALTERNATE EMBODIMENT 400

Figure 9:
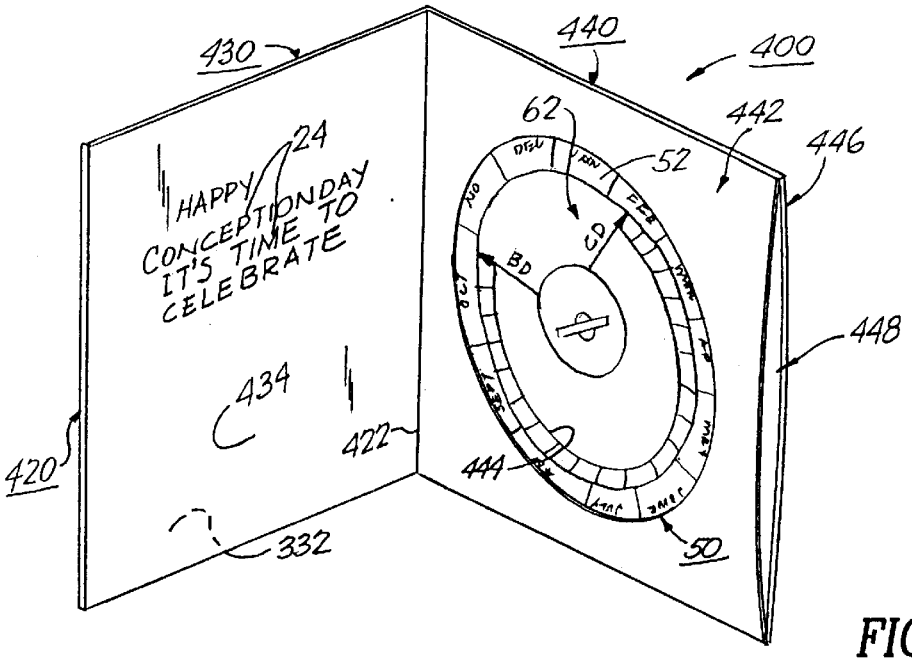
FIG. 9 is a front perspective view of the conceptionday greeting card of the fourth alternate embodiment of the present invention showing the rear panel of the card having a sleeve opening and a viewing opening for receiving the conceptionday calculation wheel therein.
Figure 10:
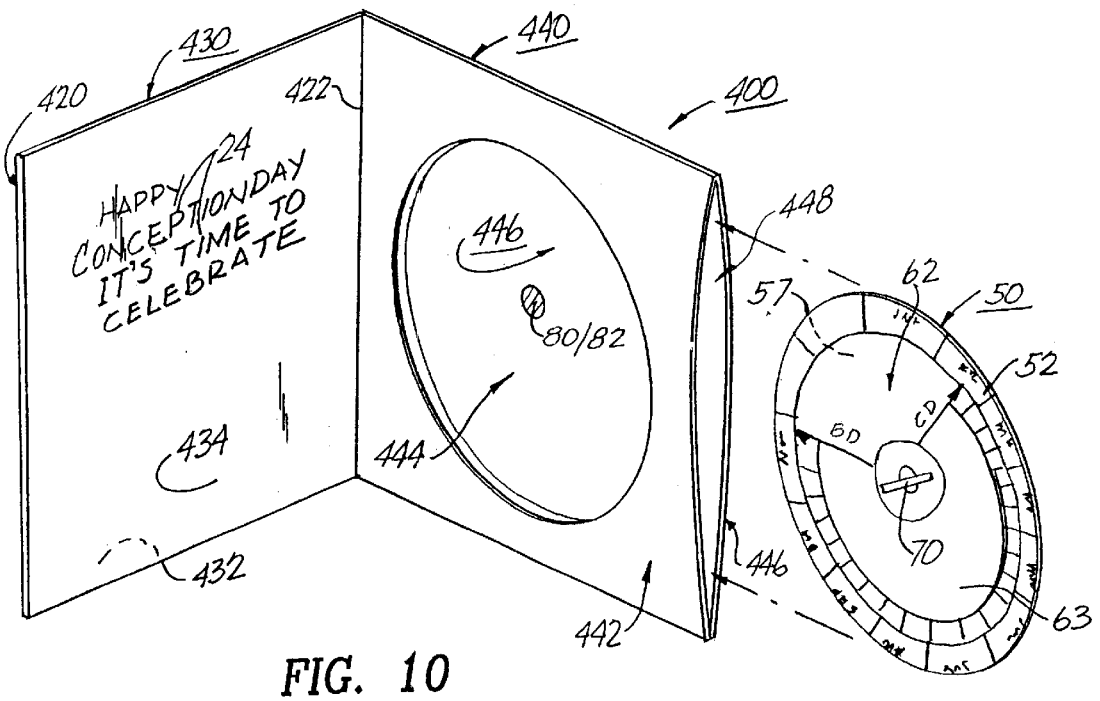
FIG. 10 is an exploded front perspective view of the conceptionday greeting card of the fourth alternate embodiment of the present invention showing the conceptionday calculation wheel being received within the sleeve opening and the viewing opening of the rear panel of the card.

The conceptionday greeting card 400 and its component parts of the fourth alternate embodiment of the present invention are represented in detail by FIGS. 9 and 10 of the patent drawings. The conceptionday greeting card 400 comprises a sheet of card stock 420 that may be white or colored, mat, smooth or glossy as desired, folded once along a vertical edge or fold line 422 [when card 400 is oriented for reading the indicia 24 (message) thereon] to form a front panel 430 and a rear panel 440. Fold line 422 can be perforated in order to separate the front panel 430 from the rear panel 440 of greeting card 400, if desired by the user. Front panel 430 includes a front wall surface 432 and a first inner wall surface 434. Each of the wall surfaces 432 and 434 of front panel 430 may include indicia 24 in the form of a message or greeting with reference to an individual's conceptionday. Rear panel 440 includes a second inner wall 442 having a centrally located aperture opening 444 and a back wall 446 for forming an interior sleeve compartment 448 for removably receiving the conceptionday calculation wheel 50 therein, as depicted in FIG. 10 of the drawings. Aperture opening 444 is for viewing and operating the conceptionday calculation wheel 50 therethrough.

OPERATION OF THE PRESENT INVENTION

In operating the conceptionday calculation wheels 50, 150 for embodiments 10, 100 and 400 as depicted in FIGS. 3, 4 and 9 of the patent drawings, the user simply places the birth date marker (↑) 64B on the users' birthday 28 for example, DECEMBER $12^{th}$ shown at 54B, and the user looks at the conception date marker (↑) 64C to find his or her conceptionday 26 of MARCH $21^{st}$ shown at 54C, as depicted in FIGS. 3 of the drawings, of the preceding year.

In operating the conceptionday calculation sliding member 260 for embodiments 200 and 300 as depicted in FIG. 6, 6A, 6B and 7 of the patent drawings, the user simply slidably moves the calculation sliding member 260 within the passageway sleeve 240 relative to the inner wall 236 of front panel 230, such that the conceptionday sliding member 260 is used to line up with the user's birthday 28. For example (as shown in FIG. 6) January 24th is shown at 264B of the indicia markings, within the first viewing window 242 and birthday marker (→) 224. This determines the conceptionday/date 26 of the user within second viewing window 244 and conception date marker (→) 226 showing a May 3rd conceptionday shown at 264C of the indicia markings, of the preceding year. In another example, as shown in FIG. 6A, September $22^{nd}$ is shown at 264B of the indicia markings of the user's birthday 28, within the first viewing window 242 and birthday marker (→) 224. This determines the conceptionday/date 26 of the user within second viewing window 244 and conception date marker (→) 226 showing a December $30^{th}$ conception date shown at 264C of the indicia markings, of the preceding year. In another example, as shown in FIG. 7, a birthday 28 of July 4th gives a conceptionday 26 of October $11^{th}$ of the preceding year.

ADVANTAGES OF THE PRESENT INVENTION

Accordingly, an advantage of the present invention is that it provides for a happy conceptionday greeting card having a conceptionday calculation wheel or sliding member on one of the cards' walls for determining an individual's conceptionday in one step.

Another advantage of the present invention is that it provides for a happy conceptionday greeting card such that the conceptionday calculation wheel includes an outer peripheral wheel section having first indicia thereon in the form of months and calendar days; and having an inner wheel section being rotatable relative to the outer peripheral wheel section and having second indicia thereon in the form of a birth date marker and a conception date marker for determining the conceptionday of an individual by simply using that individual's birth date.

Another advantage of the present invention is that it provides for a happy conceptionday greeting card wherein the conceptionday calculation wheel includes a 266 day difference between the birth date marker and the conception date marker which represents the approximate 38 week gestation period prior of pregnancy to birth of that individual.

Another advantage of the present invention is that it provides for a happy conceptionday greeting card wherein the conceptionday calculation wheel or sliding member is separable and/or detachable from the greeting card.

Another advantage of the present invention is to provide a happy conceptionday greeting card wherein the conceptionday calculation wheel or sliding member is in a cooperative relationship with the greeting card.

A further advantage of the present invention is that it provides for a happy conceptionday greeting card having a conceptionday calculation wheel or sliding member being attached thereto that can be mass produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A greeting card having a calculation wheel for determining the conception date of the user, comprising:

a) a greeting card having at least one wall;

b) a calculation wheel rotatably mounted on said at least one wall;

c) said calculation wheel having an outer peripheral section having first indicia thereon in the form of months and calendar days;

d) said calculation wheel having an inner section rotatable relative to said outer peripheral section; said inner section having second indicia thereon in the form of a birth date marker and a conception date marker; and e) rotation of said birth date marker of said inner section relative to said outer peripheral section indicates the birth date of the user for determining the conception date of the user from said conception date marker of said inner section of said calculation wheel.

2. A greeting card in accordance with claim 1, wherein said greeting card includes first and second walls.

3. A greeting card in accordance with claim 1, wherein said second indicia of said inner section further includes indicia markings in the form of weeks.

4. A greeting card in accordance with claim 2, wherein said first wall is a front wall panel having a front wall surface and a first inner wall surface; and wherein said second wall is a rear wall panel having a second inner wall surface and a rear wall surface.

5. A greeting card in accordance with claim 4, wherein said wall surfaces of said front and rear wall panels includes greeting indicia in the form of a message or greeting with reference to an individual's conceptionday.

6. A greeting card in accordance with claim 1, wherein said calculation wheel includes a first centrally located hole opening within said outer peripheral section and a second centrally located hole opening within said inner section; wherein said first and second hole openings are aligned with each other by connecting means in order for said inner section to rotatably move relative to said outer peripheral section.

7. A greeting card in accordance with claim 6, wherein said rear wall panel includes a centrally located third hole opening for alignment with said aligned first and second hole openings of said calculation wheel in order to mount said calculation wheel to said rear wall panel by said connecting means.

8. A greeting card in accordance with claim 6, wherein said connecting means include a connecting pin, a clipping member, a spindle member or a bolting member.

9. A greeting card in accordance with claim 1, wherein said birth date marker and said conception date marker on said inner section includes a gestation period of pregnancy of a overall range 250 to 280 days difference, with a preferred range of 266 to 269 days difference in determining the conceptionday of an individual user when using said calculation wheel.

10. A greeting card in accordance with claim 6, wherein said outer peripheral section is integrally connected to said rear wall panel and has a centrally located first hole opening for alignment with said second hole opening of said inner section for forming said calculation wheel and being joined together by said connecting means in order for said inner section to rotatably move relative to said outer peripheral section.

11. A greeting card in accordance with claim 10, wherein said rear wall panel includes a vertical perforated fold line for separating said rear wall panel from said front wall panel for using said calculation wheel as a single stand-alone entity.

12. A greeting card in accordance with claim 10, wherein said integrally connected outer peripheral section includes an outer perforated edging for separating said calculation wheel from said rear wall panel.

13. A greeting card in accordance with claim 5, wherein said calculation wheel includes a front wall surface and a rear wall surface for receiving said greeting indicia in the form of a message or greeting with reference to an individual's conceptionday.

14. A greeting card in accordance with claim 13, wherein said rear wall surface of said calculation wheel is affixed to said second inner wall surface of said rear wall panel by mounting means.

15. A greeting card in accordance with claim 14, wherein said mounting means includes double-sided adhesive tape, removable glue, removable cement or spray adhesive.

16. A greeting card in accordance with claim 1, wherein said greeting card is made from plastic or card stock materials having a white or colored, mat, smooth or glossy finish for imprinting of indicia thereon.

17. A greeting card in accordance with claim 1, wherein said outer peripheral section and said inner section of said calculation wheel is made from metal, plastic or card stock materials having a white or colored, mat, smooth or glossy finish for imprinting of indicia matter thereon.

18. A greeting card having a calculation member for determining the conception date of the user, comprising:

a) a greeting card having at least one wall;

b) a calculation member rotatably mounted on said at least one wall;

c) said calculation member having an outer peripheral section having first indicia thereon in the form of months and calendar days;

d) said calculation member having an inner section rotatable relative to said outer peripheral section; said inner section having second indicia thereon in the form of a birth date marker and a conception date marker; and e) rotation of said birth date marker of said inner section relative to said outer peripheral section indicates the birth date of the user for determining the conception date of the user from said conception date marker of said inner section of said calculation member.

19. A greeting card having a calculation sliding member for determining the conception date of the user, comprising:

a) a greeting card having at least one wall;

b) a calculation sliding member slidably mounted relative to said at least one wall;

c) said calculation sliding member having a front wall with indicia thereon in the form of months and calendar days;

d) said at least one wall having a passageway therethrough for slidably receiving said calculation sliding member therein;

e) said at least one wall member having first and second windows formed therein; and f) slidably moving of said calculation sliding member through said passageway relative to said at least one wall member to position said calculation sliding member to line-up with the user's birth date within said first window to determine the conception date of the user in said second window.

20. A greeting card in accordance with claim 19, wherein said greeting card includes first and second walls.

21. A greeting card in accordance with claim 20, wherein said first wall includes a front wall panel having a front wall with a front wall surface and an inner wall having a first inner wall surface; and wherein said second wall includes a rear wall panel having a second inner wall surface and a rear wall surface.

22. A greeting card in accordance with claim 21, wherein said front wall and said inner wall of said front wall panel for forming said passageway for slidably receiving said calculation sliding member therein.

23. A greeting card in accordance with claim 21, wherein said wall surfaces of said front and rear wall panels includes greeting indicia in the form of a message or greeting with reference to an individual's conceptionday.

24. A greeting card in accordance with claim 20, wherein said first wall includes a front wall panel having a front wall surface and a first inner wall surface; and wherein said second wall includes a rear wall panel having an inner front wall with an inner front wall surface and having a rear wall with a rear wall surface.

25. A greeting card in accordance with claim 24, wherein said inner front wall and said rear wall of said rear wall panel for forming said passageway for slidably receiving said calculation sliding member therein.

26. A greeting card in accordance with claim 21, wherein said birth date marker and said conception date marker on said front wall of said front wall panel includes a distance representing a gestation period of pregnancy of an overall range 250 to 280 days difference, with a preferred range of 266 to 269 days difference in determining the conceptionday of an individual user when using said calculation sliding member.

27. A greeting card in accordance with claim 24, wherein said birth date marker and said conception date marker on said inner front wall of said rear wall panel includes a distance representing a gestation period of pregnancy of an overall range 250 to 280 days difference, with a preferred range of 266 to 269 days difference in determining the conceptionday of an individual user when using said calculation sliding member.

28. A greeting card in accordance with claim 19, wherein said calculation sliding member is in the form of an elongated rectangular-shaped strip having upper and lower pull tabs thereon for pulling said strip within said passageway.

29. A greeting card in accordance with claim 19, wherein said calculation sliding member is in the form of continuous loop member having a looping device member with a turning knob thereon for turning said continuous loop member within said passageway.

30. A greeting card in accordance with claim 19, wherein said calculation sliding member is in the form of a scrolling member having upper and lower scrolling elements; each of said scrolling elements having a scrolling knob thereon for slidably moving said scrolling member upward or downward within said passageway.

31. A greeting card in accordance with claim 21, wherein said greeting card includes a vertical perforated fold line for separating said front wall panel from said rear wall panel for using said calculation sliding member as a single stand-alone entity.

32. A greeting card in accordance with claim 19, wherein said greeting card is made from plastic or card stock materials having a white or colored, mat, smooth or glossy finish for imprinting of indicia matter thereon.

33. A greeting card in accordance with claim 19, wherein said calculation sliding member is made from metal, plastic or card stock materials having a white or colored, mat, smooth or glossy finish for imprinting of said indicia matter thereon of months and calendar days.

34. A greeting card in accordance with claim 19, wherein said front wall of said calculation sliding member further includes a first column of indicia thereon in the form of months and calendar days representing 365 birth dates, and a second column of indicia thereon in the form of months and calendar days representing 365 conceptionday dates; and wherein said dates of said first column of indicia are offset from said dates of said column of indicia by a range of 266 to 269 days.

35. A greeting card having a calculation wheel for determining the conception date of the user, comprising:

a) a greeting card having at least one wall;

b) said at least one wall including a sleeve opening for slidably receiving said calculation wheel therein;

c) said calculation wheel being slidably removable from said sleeve opening;

d) said at least one wall including a viewing opening therein for operating and calculating on said calculation wheel;

e) said calculation wheel having an outer peripheral section having first indicia thereon in the form of months and calendar days;

f) said calculation wheel having an inner section rotatable relative to said outer peripheral section; said inner section having second indicia thereon in the form of a birth date marker and a conception date marker; and g) rotation of said birth date marker of said inner section relative to said outer peripheral section indicates the birth date of the user for determining the conception date of the user from said conception date marker of said inner section of said calculation wheel.

36. A greeting card in accordance with claim 35, wherein said greeting card includes a first wall and a second wall.

37. A greeting card in accordance with claim 36, wherein said first wall includes a front wall panel having a front wall surface and a first inner wall surface; and wherein said second wall includes a rear wall panel having an inner front wall with a second inner wall surface and having a rear wall with a rear inner surface and rear wall exterior surface.

38. A greeting card in accordance with claim 37, wherein said inner front wall and said rear wall of said rear wall panel for forming said sleeve opening for slidably receiving said calculation wheel therein.

39. A greeting card in accordance with claim 37, wherein said viewing opening is formed on said inner front wall and being centrally located on said inner front wall.

40. A greeting card in accordance with claim 37, wherein said wall surfaces of said front and rear wall panels includes greeting indicia in the form of a message or greeting with reference to an individual's conceptionday.

41. A greeting card in accordance with claim 37, wherein said calculation wheel is detachably mounted to said rear wall inner surface of said rear wall of said rear wall panel by mounting means.

42. A greeting card in accordance with claim 41, wherein said mounting means includes double-sided adhesive tape, removable glue, removable cement or spray adhesive.

43. A greeting card in accordance with claim 40, wherein said greeting card is made from plastic or card stock materials having a white or colored, mat, smooth or glossy finish for imprinting of said greeting indicia matter thereon.

44. A greeting card having a calculation wheel for determining the conception date of the user, comprising:

a) greeting card having at least one wall;

b) a calculation wheel in cooperative relationship with said greeting card;

c) said calculation wheel having an outer peripheral section having first indicia thereon in the form of months and calendar days;

d) said calculation wheel having an inner section rotatable relative to said outer peripheral section; said inner section having second indicia thereon in the form of a birth date marker and a conception date marker; and e) rotation of said birth date marker of said inner section relative to said user peripheral section indicates the birth date of the user for determining the conception date of the user from said conception date marker of said inner section of said calculation wheel.

* * * * *